United States Patent [19]

Mount

[11] 4,052,881

[45] Oct. 11, 1977

[54] IMPROVED PROCESS FOR PROVIDING OFFSET BENDS OF THE CORRECT DIMENSION IN PIPE AND THE LIKE

[76] Inventor: Ralph W. Mount, R.D. 1, Zelienople, Pa.

[21] Appl. No.: 601,358

[22] Filed: Aug. 4, 1975

Related U.S. Application Data

[63] Continuation of Ser. No. 322,026, Jan. 8, 1973, abandoned.

[51] Int. Cl.[2] ..... B21D 7/14; B21C 51/00

[52] U.S. Cl. ..... 72/459; 72/34

[58] Field of Search ..... 72/459, 458, 457, 149, 72/319, 310, 34, 35, 31, 32, 369; 7/14.1 R; 408/211, 212, 199, 210; 144/205

[56] References Cited

U.S. PATENT DOCUMENTS

| | | | |
|---|---|---|---|
| 2,381,064 | 8/1945 | Lewin | 72/459 |
| 2,436,776 | 2/1948 | Peapson | 72/310 |
| 2,470,392 | 5/1949 | Gassmann | 408/211 |
| 2,656,747 | 10/1953 | Lewin | 72/459 |
| 2,817,986 | 12/1957 | Benfield | 72/459 |
| 2,847,705 | 8/1958 | Hellwig | 72/459 |
| 2,932,225 | 4/1960 | Gardner | 72/459 |
| 3,246,498 | 4/1966 | Mount | 72/34 |
| 3,253,441 | 5/1966 | Benfield | 72/31 |
| 3,590,617 | 7/1971 | Mount | 72/34 |
| 3,763,510 | 10/1973 | Graham | 408/211 |

*Primary Examiner*—C.W. Lanham
*Assistant Examiner*—Gene P. Crosby

[57] ABSTRACT

A pipe bending tool has two indicators one at the upper surface between the shank and the bending finger and calibrated to determine the bending required for a given dimensional offset and the curved anvil bending surface for the tool also has calibration so that with the tool stationary the pipe can be bent around the curved anvil surface until the correct bending is effected for a given dimensional offset.

2 Claims, 9 Drawing Figures

IMPROVED PROCESS FOR PROVIDING OFFSET BENDS OF THE CORRECT DIMENSION IN PIPE AND THE LIKE

This is a continuation application of Ser. No. 322,026 filed Jan. 8, 1973, now abondoned.

BACKGROUND OF THE INVENTION

A conduit bending tool of the type disclosed in my previously issued U.S. Pat. Nos. 3,246,498 and 3,590,617 incorporates many important features of an improved "hickey" or conduit bender. What is needed, however, is a ready and convenient means, forming part of the conduit bender, which can establish the correct degree of bending for offset bends. The electrician or other worker needs a convenient gage, forming part of the conduit bender, which will determine the degree of bending for a given offset and distance connecting offset bends. For example, if an eight inch offset is desired and the distance between bends is given, the tool should have a gage reading directly, when the bend is accomplished to produce that offset with the established reverse bend locations. First, marks are made on the conduit where the reverse bends should be made. By proving the distance between the reverse bends and the degree of offset the ratio of these two distances is then read directly off of a ball gage of the conduit bender which tells when each reverse bend is sufficient to achieve the curved offset.

What is needed is a much more convenient and understandable gage reading so that the electrician or other user of the "hickey" will know the degree of bending proper for a given offset and conduit length between offset bends. That is what this invention is about.

Not only is it necessary to have a gage which will read directly the degree of bending, in the manner described, but also gage information is provided so that when the conduit bender or "hickey" is held stationary and the pipe bent around the anvil or curbed section of the bender, there is provided a convenient gage means for also determining the amount of bend to achieve as the correct offset.

The tool is versatile and can perform bending either with turning of the tool or the conduit on the bender; and, all the required measuring means are provided within the conduit bender including gages, measuring tapes and the like. Thus, the number of conduit bending operations can occur all at the preferred location and degree to obtain accurate offset bend. Moreover, when the bending is completed the end of the conduit can be reamed out both internally and externally by a reamer which is a part of the conduit bender.

OBJECTS OF THE INVENTION

A principal object of the present invention is to provide a conduit bender which has a combination of new and improved gages which can determine the extend of bending required for accurate offset bending.

Another object of the present invention is to produce in a bender or hickey a combination ball gage and marker gage for quickly and conveniently determining the extent of bending required for a given dimensional offset.

A still further object of the present invention is to provide an inexpensive but durable bending gage which includes measuring elements, gages and reamers for performing multiple tasks necessary in the bending of conduits to a given configuration including dimensional offset, stubups, back-to-back bends, offsets and the like.

Other objects and features of the present invention will become apparent from a considertion of the following description which proceeds with reference to the accompanying drawings wherein a selected example embodiment of the invention is selected by way of example and not of limitation.

DRAWINGS

Figure 3:
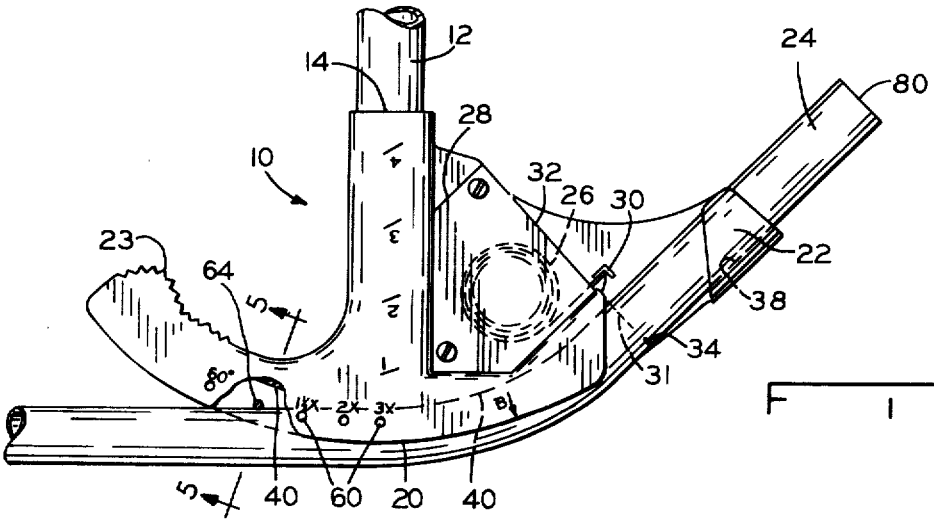
FIG. 3 illustrates the reverse side of FIG. 2.
Figure 4A:
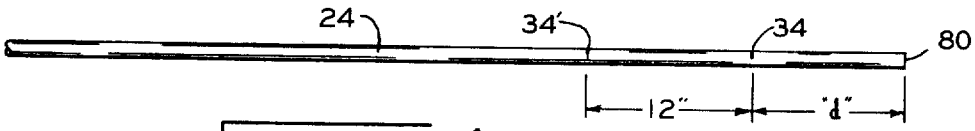
Figure 4B:
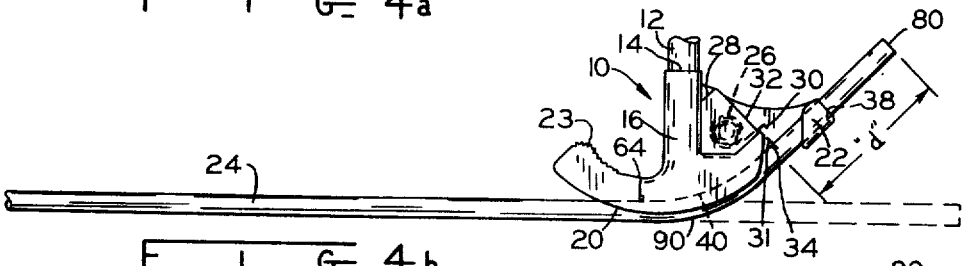
Figure 4C:
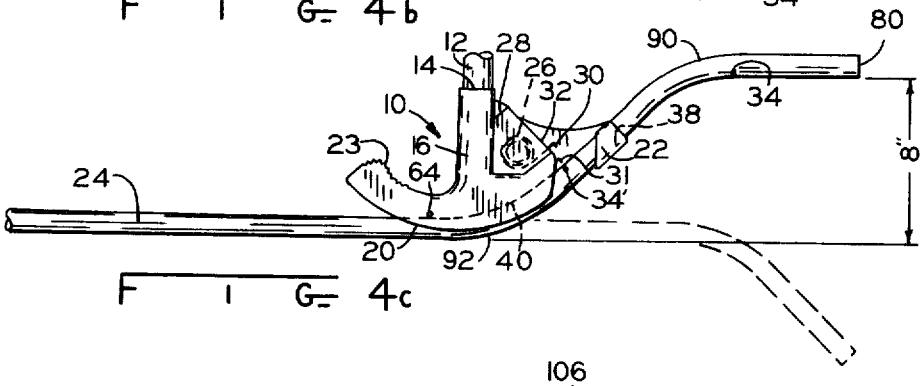
Figure 6:
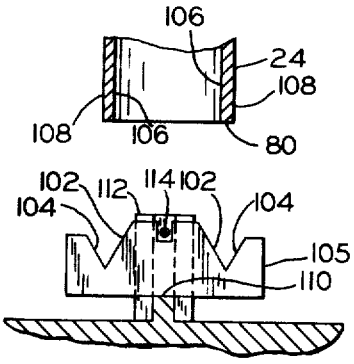
Figure 5:
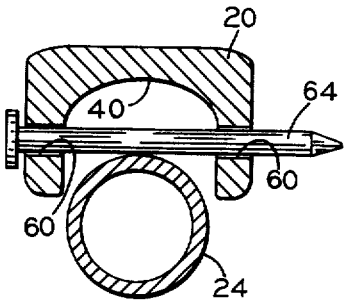
Figure 7:
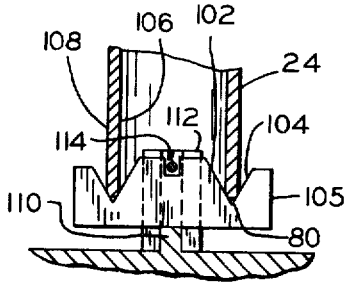

FIGS. 4*a*, 4*b* and 4*c* illustrate the procedure for effecting an offset bend at the desired location and with the offset dimension and location accurately determined according to the present invention;

FIG. 5 is a section view taken on line 5—5 of FIG. 3; and,

FIGS. 6 and 7 are enlarged sectional detail views of the end of the conduit and the reaming device which is on the tool.

DETAILED DESCRIPTION OF THE INVENTION

A conduit bender designated generally by reference numeral 10 includes a handle 12 fitting within an opening or socket 14 of bender 16. Bender 16 consists generally of a web 18 and arcuate anvil or bending section 20 with a bending finger 22 and serrated pedal or step 23 to assist the handle 12 in bending effort on conduit 24.

Within the web 18 is a measuring tape 26 which includes a casing 28 and a reel of self-winding tape having a hook end 30 which measures the location at which bending should be performed, the marking being in a line drawn from edge 31 (FIG. 4*b*) and intersecting at point 34 of conduit 24.

After the measuring is completed, the tape 26, as mentioned, is spring loaded to be self retracting and is wound within the casing 28.

During bending, the conduit 24 is passed between bending finger 22 having a concave bending surface 38 and the arcuate concave anvil surface 40 so that when the tool is turned a bend of the corresponding curvature is developed at location 34, marked off by the measuring tape 30. The degree of bending is determined by an indicator tube 50 which is closed at its ends and is provided with angular markings 52. These markings are calibrated in terms of "X3", "X2", "X½", etc. it being understood that the calibration marking can change, however, depending upon the particular information relative to the bend that is desired.

The degree of bending is read by means of two balls 56 which are end-to-end and which rest at the lowest part of the indicator conduit opposite the marking which indicates the angle of bend provided by the bending tool. The indicator is accurate and the balls 56 roll easily within the tube to rest constantly at the lowest part of the tube opposite the mark which indicates the degree of bending effected by the tool.

Figure 1:
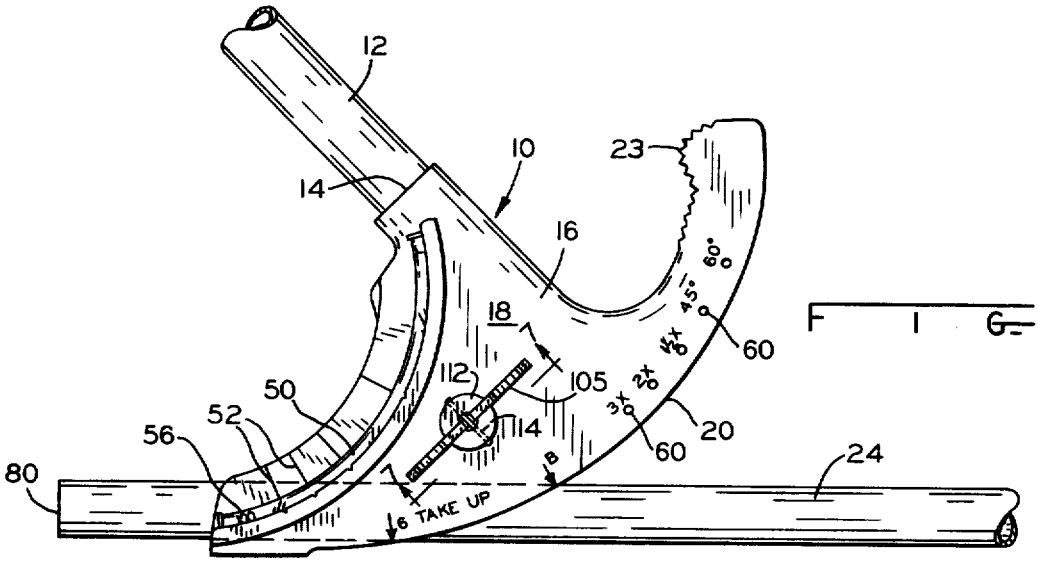
FIG. 1 is a side elevation view of a bending tool and conduit at the initial part of the bending operation.
Figure 2:
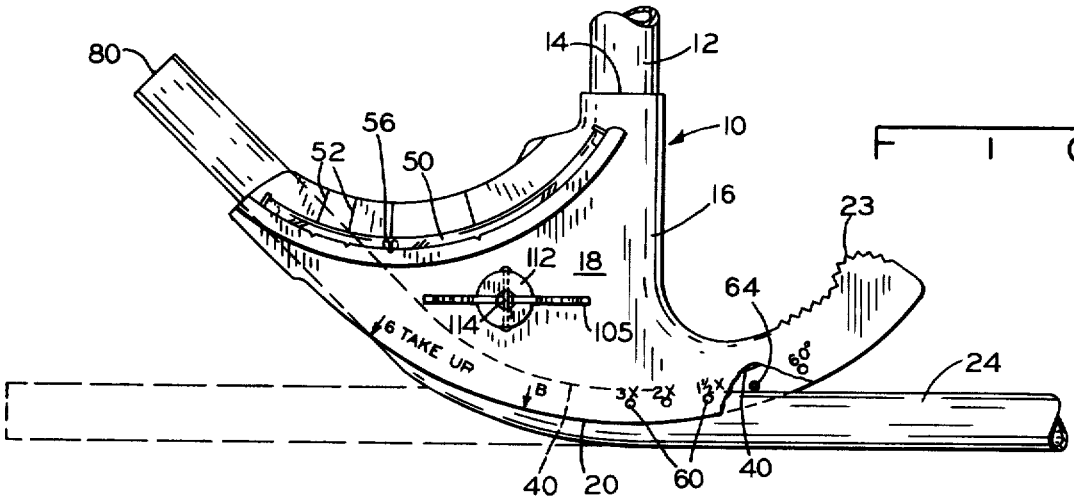
FIG. 2 is the same as FIG. 1 but illustrating the bending tool and conduit after bending has been performed.

At the undersurface of anvil portion of the tool are a series of spaced openings 60 (FIG. 1) which are calibrated to indicate "3X", "2X", "½", "45°" and "60", etc. which are indicators determining the amount of bend in a somewhat different manner. In this case, the tool is fixed and the conduit is "wrapped"around the anvil, by bending it until the section of conduit is brought opposite one or the other of the marks "3X", "2X", "½", etc. A nail or other member 64 (FIG. 5) is passed through the openings 60 in the curved annular anvil section 40 and the pipe bent until it comes into contact with the nail 64 at which time the bending is completed. One of the important advantages of the present invention is the ease with which offset bending is achieved with precise dimensional forming. Such precision forming is an important advantage of the present invention and will be next described in connection with FIGS. 4*a*, 4*b* and 4*c*: Suppose, for example, that an offset bend of 8 inches (FIG. 4*c*) is desired. The first step is to measure the distance "*d*" from the end 80 of conduit 24 (FIG. 4*a*). Assuming that a offset of 8 inches is to be determined over a distance of 12 inches (FIG. 4*c*) between offset bends 90, and 92, then an offset ratio of 12 inches to 8 inches would be 1-½/1 and this reading is directly read off of the gage 50 in making reverse bends at 90 and 92. After determining the offset of 8 inches, the tape is used to measure off a distance 12 inches, from bend 90 to bend 92 and the tool then bends offset bends at 90 and 92 until the angle corresponds to 1-½/X on the gage.

In complete description of an offsetting bend procedure the sequence of steps are therefore as follows:

1. Measure from end 80 where the first bend is to be determined and mark that point 90.
2. The location of the second bend 92 is then measured by the tape. The ratio of the offset to the distance between 90 and 92 is then determined as a ratio which is 1-½X, 2X, 3X, etc. and reverse bends are then performed at 90 and 92 until the gage reading corresponds to the 1-½X, 2X, 3X reading, etc.

If it is desired to obtain an offset bend with the gage at the anvil rather than with the ball gage, the same procedure is followed, i.e., first measuring the distance from the end of the conduit 80 to the first bend 90, then measure the distance between the offset bends, i.e. from 90 to 92 and then reverse bends are performed by holding the tool still and bending the pipe first at 90 and then at 92 the extent of the bending determined by the ratio of the offset to the distance between the reverse bends. Thus, if that ratio 1-½X, 2X, 3X, etc., the pipe is bent until the pipe or conduit contacts the nail 64 at the openings indicating that offset ratio. For example, if the offset is 8 inches and the distance between reverse bends 90, 92, is 12 inches than the conduit is bent 1-½X which is marked off by the nail 64 in the 1-½X opening.

After the bending is completed, the end 80 of the pipe or conduit can be reamed at both the inner and outer surfaces by means of cutting surfaces 102 and 104 which are formed as reverse conical cutting surfaces so that the inner edge 106 is reamed by conical surface 102 and outer edge 108 is reamed by conical surface 104. The two conical surfaces are floatingly related, one to the other, the conical surface 102 being spring mounted so that it will conform to various circumferential measurements of the end of the conduit. Thus, as indicated in FIG. 7 the end 80 of the conduit is forced downwardly into the apex 108 which is formed between the reversely formed conical surfaces 102 and 104 until both the inner and outer edges of the conduit are engaged by the cutting surfaces 102 and 104 and either the tool or the conduit are then rotated until the reaming operation is satisfactorily performed.

The reamer designated generally by reference numeral 105 is balanced on pivot 110 so that, it can pivotally float to whatever position is desired to meet the incoming end 80 of the conduit 24 when the conduit is moved from the position of FIG. 6 to the reaming position of FIG. 7. The reamer is held in proper position by a post 112 having a pin 114 which is passed through the post and reamer to join the two parts together.

Although the present invention has been illustrated and described with offset bending, it should be understood that the gage and tool is useful to form 90° stubup bends and back-to-back bends as well, by measuring with the tape to the location where the bend is desired, and then bending until the gage reading corresponds to the particular angle desired at the bend.

Although the present invention has been illustrated and described in connection with a single example embodiment it will be understood that this is illustrative of the invention and is by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. The process for effecting offset bends in pipe and the like with a bending tool having an arcuate concaved anvil surface with pairs of predetermined stop location openings disposed angularly about said anvil, comprising the steps of inserting a cross member through a selected pair of aligned openings in the walls of the concaved anvil surface to form a stop and at an anvil location corresponding to the ratio of the offset to the distance between the respective bends, disposing the bending tool at a predetermined distance from the end of the pipe at the location where the first bend is to be effected, and with the bending tool and anvil in position, wrapping the pipe around the anvil until contacting said stop to perform a first bend, relocating the anvil to a second location on the pipe where reverse bending is to be performed determined by the value of said ratio and wrapping the pipe around the anvil until the pipe comes in contact with said stop to effect a combination of offset bending which is determinative of the ratio of the offset of the respective bends and the distance between said bends, and following the bending operation, reaming the end of the pipe or conduit with a reamer integral with the bending tool.

2. The process in accordance with claim 1, including the step of coupling the handle to a shank of the bending tool in preparation for bending operation.

* * * * *